US005235351A

United States Patent [19]

Koizumi

[11] Patent Number: 5,235,351

[45] Date of Patent: Aug. 10, 1993

[54] LIQUID EJECTION RECORDING HEAD INCLUDING A SYMBOL INDICATING INFORMATION USED FOR CHANGING THE OPERATION OF THE HEAD

[75] Inventor: Yutaka Koizumi, Hiratsuka, Japan

[73] Assignee: Canon Kabushiki Kaisha, Tokyo, Japan

[21] Appl. No.: 866,280

[22] Filed: Apr. 13, 1992

Related U.S. Application Data

[63] Continuation of Ser. No. 708,813, May 31, 1991, abandoned, which is a continuation of Ser. No. 401,548, Aug. 31, 1989, abandoned, which is a continuation of Ser. No. 77,993, Jul. 24, 1987, abandoned, which is a continuation of Ser. No. 712,748, Mar. 18, 1985, abandoned.

[30] Foreign Application Priority Data

Mar. 31, 1984 [JP] Japan ..... 59-64113
Mar. 31, 1984 [JP] Japan ..... 59-64114

[51] Int. Cl.[5] ..... B41J 2/05; B41J 25/34

[52] U.S. Cl. ..... 346/140 R; 400/126; 400/175

[58] Field of Search ..... 346/140, 75, 139 C; 400/126, 175

[56] References Cited

U.S. PATENT DOCUMENTS

| | | | |
|---|---|---|---|
| 4,030,588 | 6/1977 | Hanagata | 346/76 PH |
| 4,281,936 | 8/1981 | Phillips | 400/175 |
| 4,296,421 | 10/1981 | Hara | 346/140 |
| 4,370,666 | 1/1983 | Noda et al. | 346/76 PH |
| 4,386,862 | 6/1983 | Kittel | 400/175 X |
| 4,396,923 | 8/1983 | Noda | 346/76 PH |
| 4,411,540 | 10/1983 | Nozaki | 400/175 |
| 4,448,555 | 5/1984 | Hasegawa | 400/175 X |
| 4,500,195 | 2/1985 | Hosono | 355/3 R |
| 4,554,559 | 11/1985 | Heath | 346/76 PH |
| 4,746,936 | 5/1988 | Takahashi . | |
| 4,803,521 | 2/1989 | Honda . | |

OTHER PUBLICATIONS

Lonis, Robert A.; Storage of Operating Parameters in Memory Integral with Printhead; Xerox Disc Journal, V8, N6 N/D 1983, p. 503.

Okcuoglu et al.; Pitch Sensing Device; IBM TDB V24, N1A, Jun. 1981, pp. 146–147.

*Primary Examiner*—Joseph W. Hartary

*Attorney, Agent, or Firm*—Fitzpatrick, Cella Harper & Scinto

[57] ABSTRACT

A liquid ejection recording head in which information associated with energy generating members for forming flying droplets discharged from discharge ports is symbolized and recorded at a predetermined location on the head.

23 Claims, 9 Drawing Sheets

LIQUID EJECTION RECORDING HEAD INCLUDING A SYMBOL INDICATING INFORMATION USED FOR CHANGING THE OPERATION OF THE HEAD

This application is a continuation of application Ser. No. 07/708,813 filed May 31, 1991, now abandoned, which in turn is a continuation of application Ser. No. 07/401,548 filed Aug. 31, 1989, now abandoned, which in turn is a continuation of application Ser. No. 07/077,993 filed Jul. 24, 1987, now abandoned, which in turn is a continuation of application Ser. No. 06/712,748 filed Mar. 18, 1985, now abandoned.

BACKGROUND OF THE INVENTION

1. Field of the Invention

This invention relates to a liquid ejection recording apparatus for ejecting flying droplets to a recording medium and recording character images or the like thereon and to a liquid ejection recording head used in such apparatus, and more particularly, to a liquid ejection recording head suitable for being removably mounted on a carriage scanning relative to the recording medium and to a liquid ejection recording apparatus in which a driving voltage for driving the liquid ejection recording head is adjustable for each liquid ejection recording head.

2. Description of the Prior Art

The non-impact recording methods have recently drawn attention in that the occurrence of noise during the recording is negligibly small. Among them, the ink jet recording method (the liquid ejection recording method) which is capable of accomplishing high-speed recording and moreover, can accomplish full color printing without requiring a special process of fixation for recording on plain paper is a very effective recording method, and various types of such recording method have heretofore been proposed and some of them have already put into commercial use and some of them are still being studied Such liquid ejection recording method effects the recording by causing droplets of recording liquid called ink to fly and adhere to a recording medium, and may be divided broadly into several types by the method of forming the droplets of the recording liquid and the method of controlling the direction of flight of the formed droplets.

Among them, the liquid ejection recording methods disclosed, for example, in U.S. Pat. Nos. 3,683,212, 3,747,120 and 3,946,398 are the so-called drop-on-demand recording method in which droplets are discharged from discharge orifices in accordance with a recording signal and these droplets are caused to adhere to the surface of a recording medium to thereby accomplish the recording. In this recording method, only the droplets necessary for the recording are discharged and therefore, it is not necessary to install any special means for recovering or treating the discharged liquid unnecessary for the recording and thus, the apparatus itself can be made simple and compact and nowadays, this recording method particularly attracts attention due to the fact that it is unnecessary to control the direction of flight of droplets discharged from discharge orifices and the fact that multi-color recording can be accomplished easily.

A liquid ejection recording method entirely different from the above-described liquid ejection recording method in the principle of formation of flying droplets is disclosed in Japanese Laid-Open Patent Application No. 51837/1979. This liquid ejection recording method is not only very effectively applicable to said drop-on-demand recording method, but also can easily realize a highly dense multi-orifice recording head, and therefore, it has a feature that recorded images of high resolution and high quality can be obtained at a high speed.

The liquid ejection recording apparatus used in these drop-on-demand recording methods is usually of a structure having a recording head comprised of discharge ports (orifices) for discharging droplets, liquid flow paths communicating with the orifices and having energy generating elements for forming flying droplets, and a liquid chamber communicating with the liquid flow paths and storing therein liquid to be supplied to these flow paths.

However, in the liquid ejection recording apparatus having the construction as described above, the optimum driving voltages inherent to the liquid ejection recording heads thereof are different and irregular, and therefore, it is necessary to adjust a driving voltage generating circuit in the liquid ejection recording apparatus in accordance with the optimum driving voltage inherent to the liquid ejection recording head.

If this adjustment is neglected, the following problem will arise. That is, when a liquid ejection recording head whose inherent voltage is higher than the driving voltage supplied from the driving voltage generating circuit of the liquid ejection recording apparatus is mounted on the recording apparatus, stable flying droplets cannot be obtained or, in the worst case, droplets cannot be discharged. Conversely, when a liquid ejection recording head whose inherent voltage is lower than the driving voltage supplied from the driving voltage generating circuit of the liquid ejection recording apparatus is mounted on the recording apparatus, unnecessary droplets, called satellites, are secondarily ejected or an excessively great load is applied to the energy generating elements to remarkably reduce their service life, and in the worst case, the energy generating elements may be destroyed.

Accordingly, when the liquid ejection recording head is to be interchanged by reason of trouble with it or the like, a high-degree of maintenance work which requires a part of the driving voltage generating circuit to be changed becomes necessary, and this has led to a problem that the manufacturer must make expensive liquid ejection recording heads whose trouble rate is very low.

In fact, in the liquid ejection recording apparatus of this type, the liquid ejection recording head (hereinafter referred to simply as the head) has often been interchanged from the viewpoint of securing the reliability of the head. However, each head has its inherent optimum driving voltage and the value of that voltage differs from head to head, and therefore, it has been necessary to adjust the driving voltage generating circuit in the liquid ejection recording apparatus in accordance with the optimum driving voltage value of the head.

Thus, each manufactures has shown the optimum driving voltage value by directly writing the voltage value on the head or by sticking, on the head, a label on which the optimum driving voltage value is written.

Therefore, when actually interchanging the head, a cumbersome procedure wherein according to the voltage value written or stuck on the head, the operator such as the user or serviceman must adjust the driving voltage generating circuit on the basis of a corresponding table, or the like, which must be resorted to. Also, the voltage value directly written on the head is apt to fade away during the transportation or the label stuck on the head may peel off during transportation, and this has led to the occurrence of a trouble that the driving voltage value becomes unknown.

SUMMARY OF THE INVENTION

It is an object of the present invention to eliminate the above-noted disadvantages and to provide a liquid ejection recording head having an accurate and clear driving voltage display which can be automatically read.

It is another object of the present invention to provide a liquid ejection recording apparatus in which the driving voltage display of the liquid ejection recording head can be read to adjust the driving voltage to a level suitable for individual liquid ejection recording heads and thereby ensure stable image recording.

It is still another object of the present invention to provide a liquid ejection recording head in which the value of the optimum driving voltage supplied to energy generating members for forming flying droplets is symbolized and recorded at a predetermined location on the head.

It is yet another object of the present invention to provide a liquid ejection recording apparatus having a liquid ejection recording head provided with discharge ports and energy generating members for generating energy used to discharge liquid and form flying droplets, and a carriage for mounting said liquid ejection recording head thereon and wherein reading means is provided for reading the symbol of a driving voltage value supplied to said energy generating members which is symbolized and recorded on said liquid ejection recording head.

It is a further object of the present invention to provide a liquid ejection recording apparatus which comprises a liquid ejection recording head having energy generating members for generating energy utilized to form flying droplets and a symbol recording the value of a driving voltage supplied to said energy generating members, voltage generating means for generating said driving voltage supplied to said energy generating members, reading means for reading the recorded content of said symbol, and control means for controlling the voltage of said voltage generating means in accordance with said recorded content read by said reading means and in which the adjusting operation during the mounting and the interchange of said recording head is easy.

DESCRIPTION OF THE PREFERRED EMBODIMENTS

The liquid ejection recording head of the present invention will hereinafter be described in detail with reference to the drawings.

Figure 1:
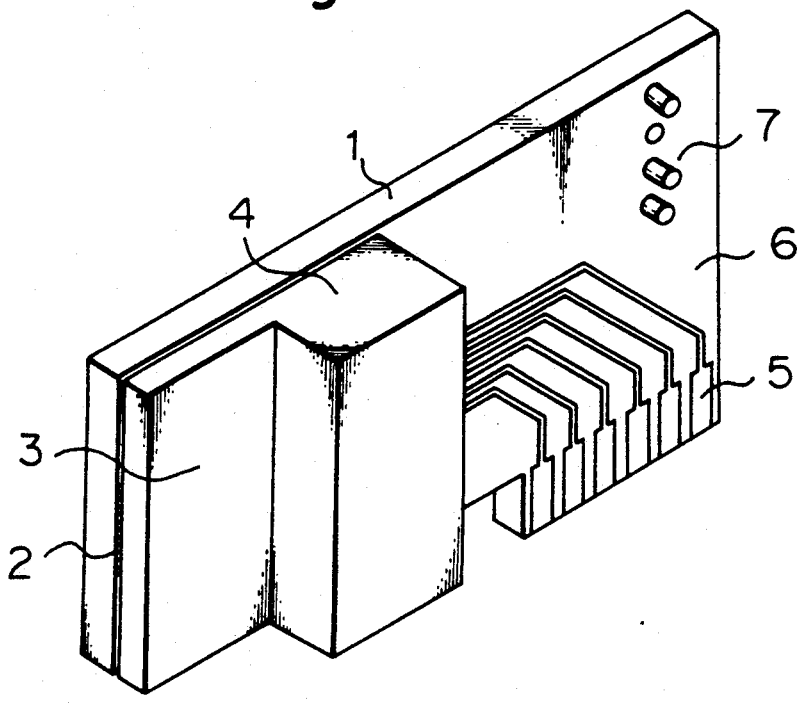
FIG. 1 is a schematic perspective view showing an example of the construction of the liquid ejection recording head of the present invention.

Referring to FIG. 1, which shows the construction of the liquid ejection recording head of the present invention, reference numeral 1 generally designates the liquid ejection recording head. Reference numeral 2 denotes discharge ports for discharging flying droplets, reference numeral 3 designates a liquid flow path constituting portion for constituting liquid flow paths having energy generating elements for generating flying droplets and communicating with the discharge ports 2, reference numeral 4 denotes a liquid chamber constituting portion for constituting a liquid chamber for storing therein liquid to be supplied to the liquid flow paths, and reference numeral 5 designates wires for supplying a driving voltage to the energy generating elements in the liquid flow paths.

Figure 2:
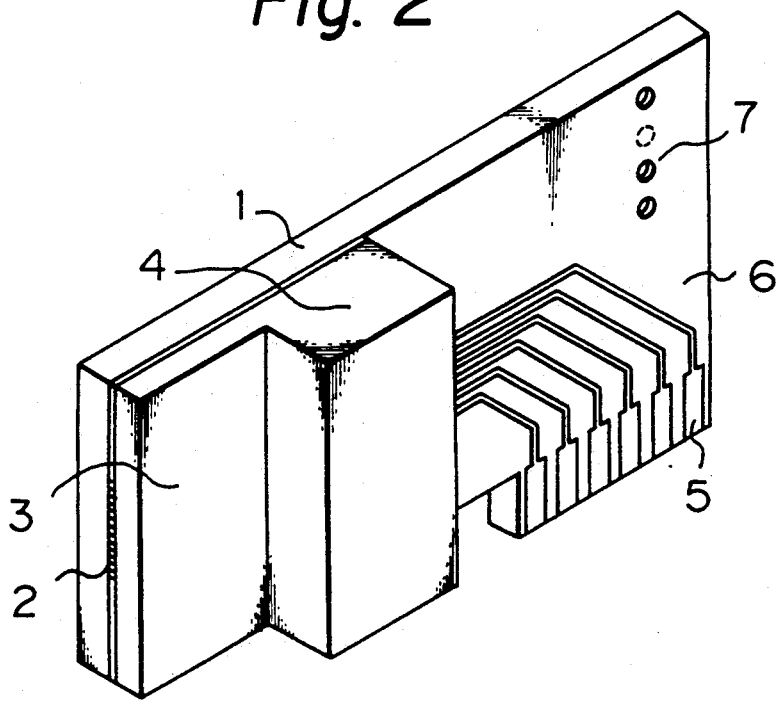
FIG. 2 is a schematic perspective view showing another embodiment of present invention.

Reference numeral 7 designates a symbol display in which the driving voltage value inherent to the liquid ejection recording head 1 is displayed and recorded in a binary form at a predetermined position on the head. This symbol display 7 actually belongs to a substrate (for example, a substrate of ceramics, glass, plastics or the like) 6 on which the wires 5 are provided, and when the liquid ejection recording head 1 is inspected for shipping by the manufacturer, the protrusions of the symbol display are cut away by pincers or the like in accordance with the driving voltage value inherent to this recording head measured during the inspection, so as to represent binary numbers obtained by transforming the voltage value into a binary form. Thus, the symbol display 7 clearly and accurately displays the driving voltage value inherent to the recording head by binary numbers, for example, with the protrusions as "1" and the positions at which the protrusions have been cut away as "0". FIG. 2 shows another embodiment of the present invention. In FIG. 2, components 1-6 are similar to those in FIG. 1, but the substrate 6 representing the symbol display 7 is initially formed with through-apertures, and these apertures are filled up with an adhesive agent or the like in accordance with the driving voltage value inherent to the recording head when the recording head is inspected for shipping by the manufacturer. In this case, the symbol display 7 is represented, for example, by binary numbers with the apertures as "1" and the positions at which the apertures have been filled up as "0".

The symbol display 7 in the embodiments of FIGS. 1 and 2 uses a 4-bit display, but the meaning of the symbol display will not be changed even if the number of bits is increased or decreased in accordance with the width of the driving voltage and the resolving power on the side which supplies the voltage. Also, a symbol display such as a bar code display is considered to be a symbol transformed into a binary form and therefore, can be applied to the present invention. Also, the binary numbers of these symbol displays 7 can be read by conventional symbol reading means such as a photosensor or a photocoupler, and the driving voltage automatically adjusted on the basis of the driving voltage value of the thus read binary numbers can be supplied to the energy generating elements in the liquid flow paths. Consequently, it becomes unnecessary to adjust the driving voltage generating circuit by hand and also, since the binary numbers are displayed by protrusions or apertures, the inconvenience that the driving voltage value becomes unknown is eliminated.

Figure 3:
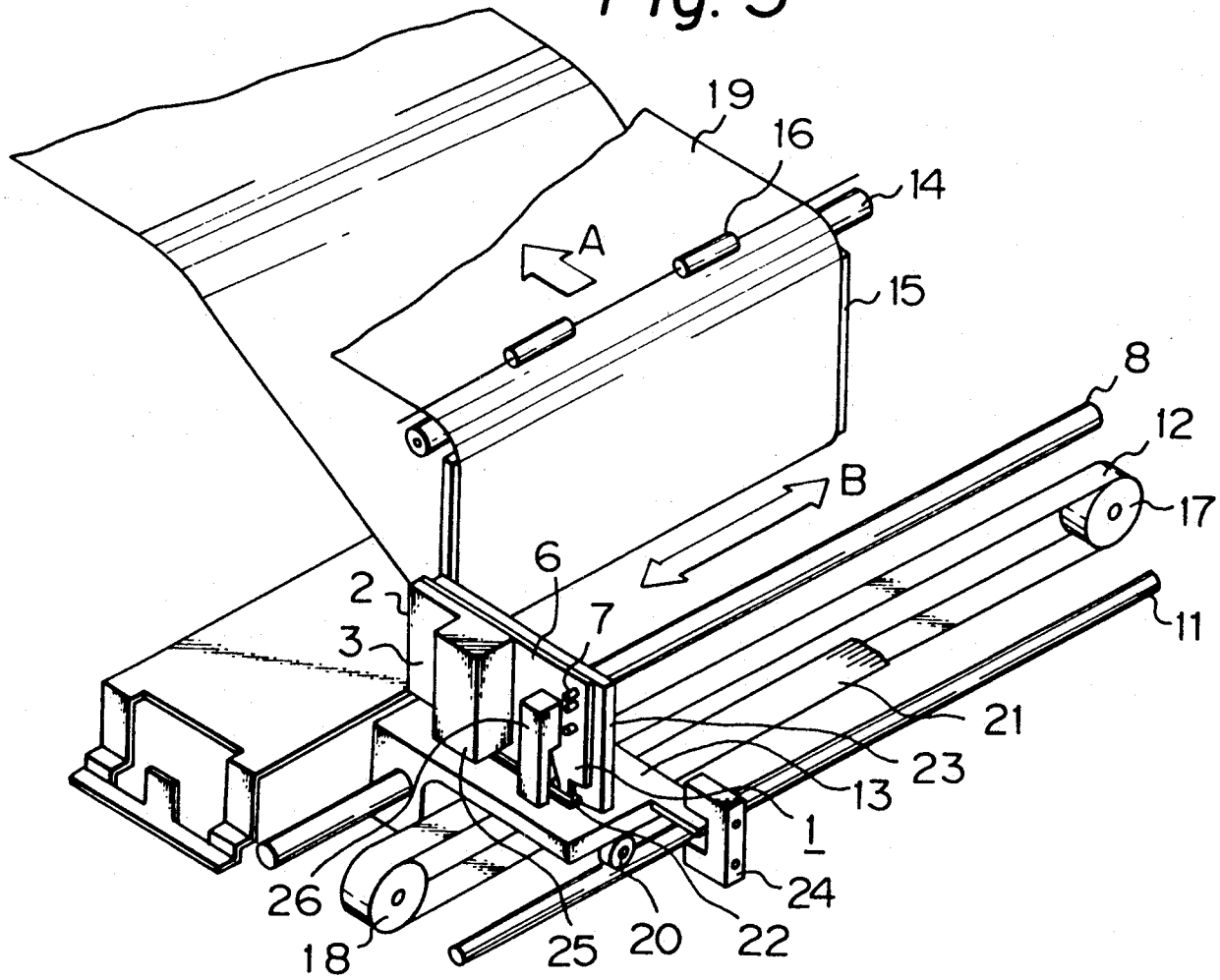
FIG. 3 is a perspective view schematically showing an example of the construction of the liquid ejection recording apparatus of the present invention.

FIG. 3 is a perspective view schematically showing an embodiment of the liquid ejection recording apparatus of the present invention. In FIG. 3, reference numeral 19 designates recording paper. The recording paper 19 is moved on a platen 15 at a predetermined speed in the subsidiary scanning direction (the direction of arrow A) by a paper feeding roller 14 and a pinch roller 16. Reference numerals 17 and 18 denote pulleys supported on respective shafts and rotated by a drive source (not shown). A carriage driving belt 12 is passed over the pulleys 17 and 18.

A carriage 13 is integrally fixed to the carriage driving belt 12. The carriage 13 is guided by guide shafts 8 and 11 and is reciprocally movable in the major scanning directions (the directions of arrow B) by the rotation of the pulleys 17 and 18. A roller 20 adapted to roll on the guide shaft 11 is disposed on the underside of the carriage 13.

A connector 22 electrically connected to flexible wiring 21 is disposed substantially in the central portion of the carriage 13, and a head aligner 23 for aligning the liquid ejection recording head (hereinafter referred to simply as the recording head) 1 when the wires 5 of the recording head 1 are connected and fixed to the connector 22 is vertically provided on the carriage 13. Accordingly, the recording head 1 is removable from the carriage 13 by the connector 22. Also, a sensor 24 for detecting the home position of the carriage 13 is provided.

The recording head 1 has a substrate 6, which in turn has thereon discharge ports 2 for discharging ink droplets which are flying droplets, a liquid flow path constituting portion 3 for constituting liquid flow paths communicating with the discharge ports 2 and having energy generating members such as heat generating elements for forming flying ink droplets, and an ink chamber for storing therein ink to be supplied to the liquid flow paths. To the energy generating members of the recording head 1, a driving voltage is supplied from a driving voltage generating circuit 29 shown in FIG. 4 through the connector 22 and the flexible wiring 21 and also, a discharge control signal for controlling the discharge of ink droplets from the discharge ports 2.

Further, the recording head 1 is provided with the symbol display 7 (FIGS. 1 and 2) which is a driving voltage displaying, portion displaying in advance, in binary numbers, the optimum driving voltage inherent to the recording head 1, i.e., the driving voltage supplied to the energy generating members for generating energy utilized to form the flying droplets. The optimum driving voltage displayed by the symbol display 7 (FIGS. 1 and 2) is measured when the recording head 1 is inspected for shipping, and in conformity with the measured value, the symbol display is provided in the form of 4 bits on the substrate 6 represented, for example, by the presence or absence of projections.

Reference numeral 26 designates a reading unit which is provided on the carriage 13 at a position opposed to the symbol display 7 provided on the substrate 6 of the recording head 1 and which reads the display content of the symbol display 7, i.e., the voltage value.

Figure 4:
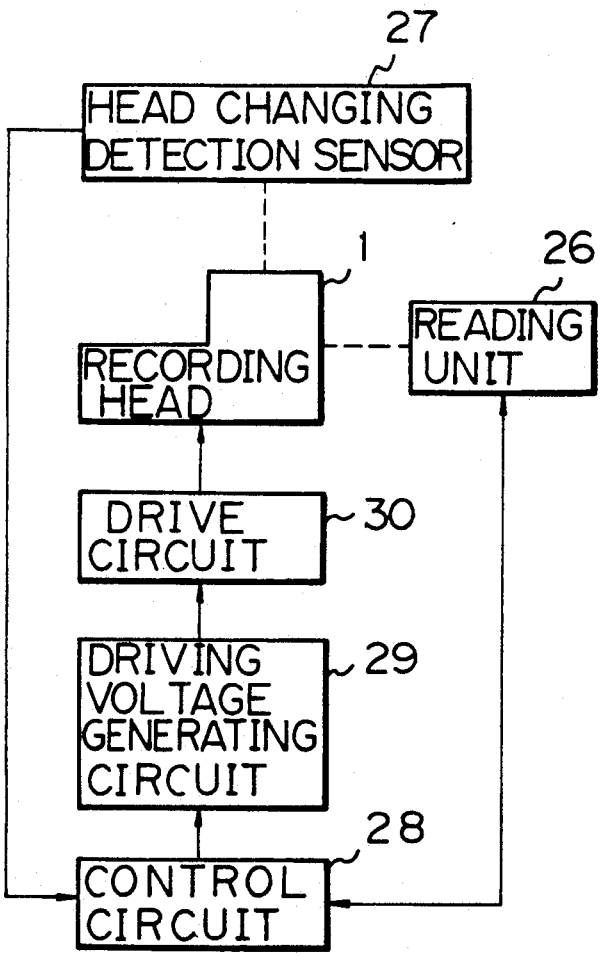
FIG. 4 is a block diagram showing an example of the construction of the electrical system of the apparatus of the present invention.

FIG. 4 is a block diagram showing an example of the electrical system of the apparatus of the present invention.

In FIG. 4, reference numeral 27 designates a head changing detection sensor disposed at a predetermined location in FIG. 3 so as to detect the changing of the recording head 1. Reference numeral 28 denotes a control circuit actuated by the head changing detection sensor 27 to actuate and control the reading unit 26 and also, control a driving voltage generating circuit 29 so as to generate the voltage displayed at the symbol display 7 of the recording head 1. This control circuit 28 is electrically connected to the head changing detection sensor 27 and the reading unit 26 through the flexible wiring 21. Reference numeral 30 designates a drive circuit for driving the energy generating members of the recording head 1. A driving voltage is supplied to the drive circuit 30 from the driving voltage generating circuit 29.

Figure 5:
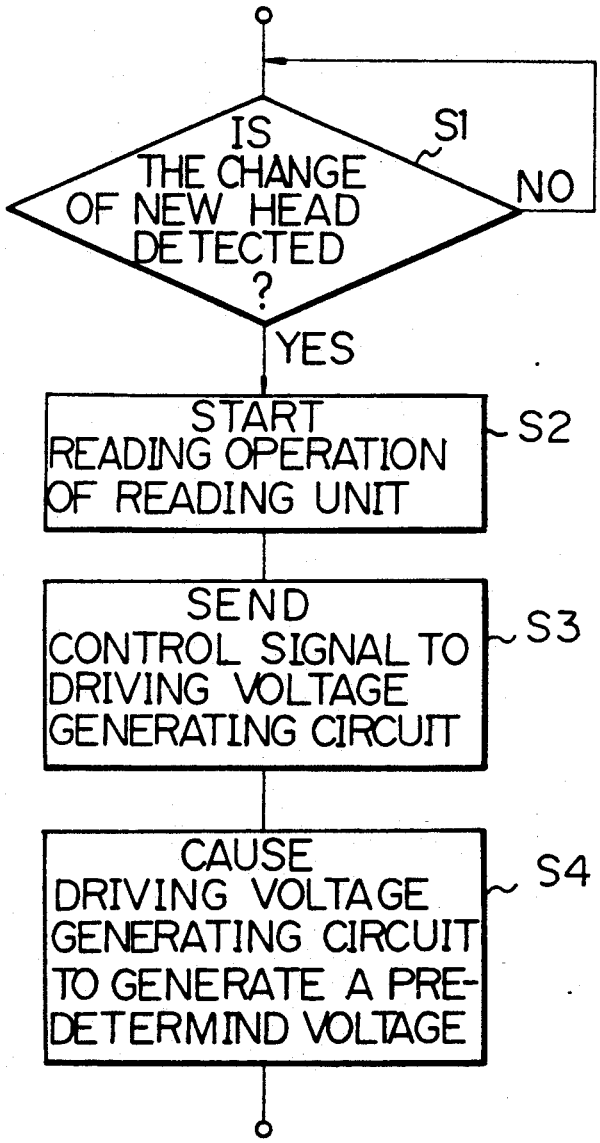
FIG. 5 is a flow chart showing an example of the control process of the control circuit shown in FIG. 4.

The control process of the control circuit 28 shown in FIG. 4 will now be described wit reference to the flow chart of FIG. 5.

When the head changing detection sensor 27 detects that the recording head 1 has been newly changed (step S1), the detection output thereof is supplied to the control circuit 28. Subsequently, the control circuit 28 instructs the reading unit 26 to read the driving voltage displayed at the symbol display 7 of the recording head 1 (step S2).

Then, the control circuit 28 delivers a control signal to the driving voltage generating circuit 29 on the basis of the voltage read from the symbol display 7 by the reading unit 26 so as to generate the same voltage as the driving voltage displayed at the symbol display 7 of the recording head 1 (step S3). In response to this control signal, the driving voltage generating circuit 29 generates the driving voltage displayed at the symbol display 7 of the recording head 1 (step S4), and this voltage is supplied to the drive circuit 30 to enable the energy generating members of the recording head 1 to be driven.

In the above-described embodiment, it has been described that the setting of the driving voltage inherent to the recording head is effected during the changing of the recording head, but instead, it is possible to re-set the driving voltage at each predetermined time in the same recording head. Also, of course, in the liquid ejection recording apparatus of the present invention, the recording head may have a single discharge port or may have a multinozzle having multiple discharge ports. Further, of course, the recording head may be of the type in which a plurality of recording heads are mounted on the carriage.

Furthermore, in the above-described embodiment, the driving voltage display of the recording head has been shown as being in the form of the presence of four projections, but instead, this driving voltage display may be in any form of display. Still further, the reading unit for reading the driving voltage display of the recording head may be of any type if it can read in accordance with the form of the driving voltage display of the recording head.

According to the present invention, as described above, a driving voltage inherent to the liquid ejection recording head mounted on the carriage can be set for each recording head by simple means and therefore, the problem peculiar to the prior art that each time the recording head is mounted or changed, the driving voltage thereof must be adjusted is greatly alleviated and thus, the operability of the recording head can be improved much more.

Figure 6:
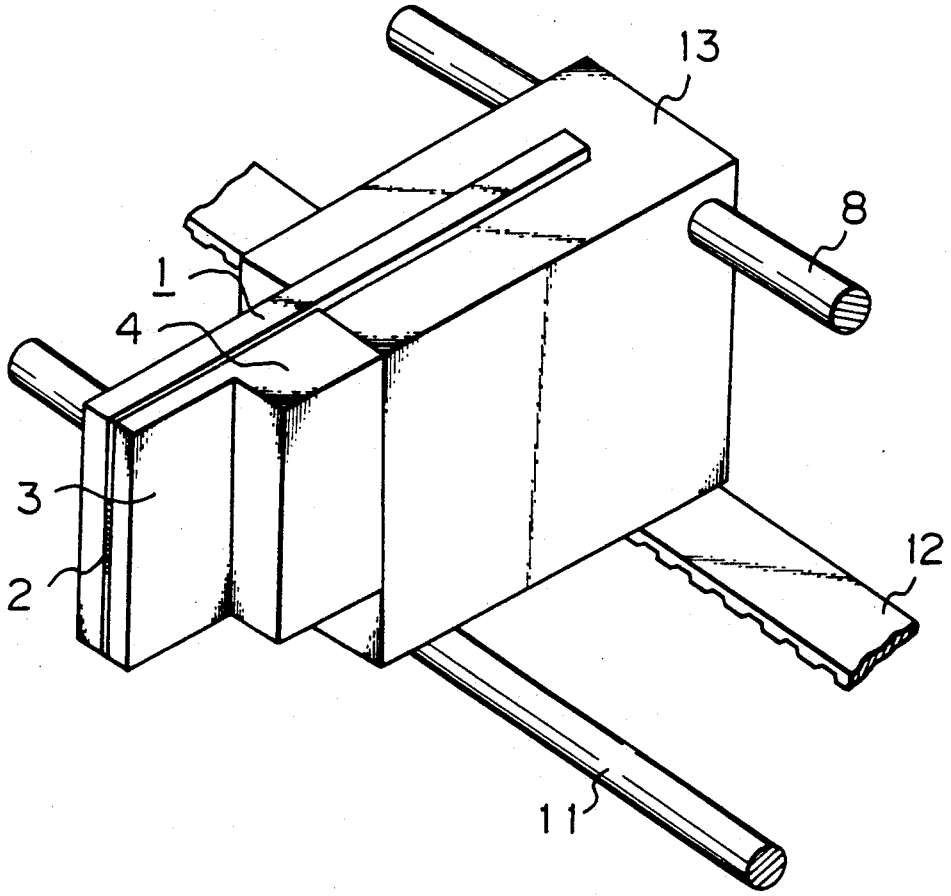
FIG. 6 is a schematic perspective view showing another example of the construction of the essential portions of the liquid ejection recording apparatus of the present invention.

FIG. 6 is a schematic perspective view showing an example of the construction of the essential portions of a liquid ejection recording apparatus on which the recording head shown in FIG. 2 is mounted. Reference numerals indicated in FIG. 6 are similar in significance to those indicated in FIGS. 1 to 3. In FIG. 6, reference numerals 8 and 11 designate guide rails for scanning the carriage 13, which is moved along a recording medium, not shown, by the belt 12.

The liquid ejection recording head 1 is fitted and fixed to a fitting portion provided on the carriage 13. Reading means for reading the symbol recorded on the head 1 is provided in the carriage 13.

Figure 7:
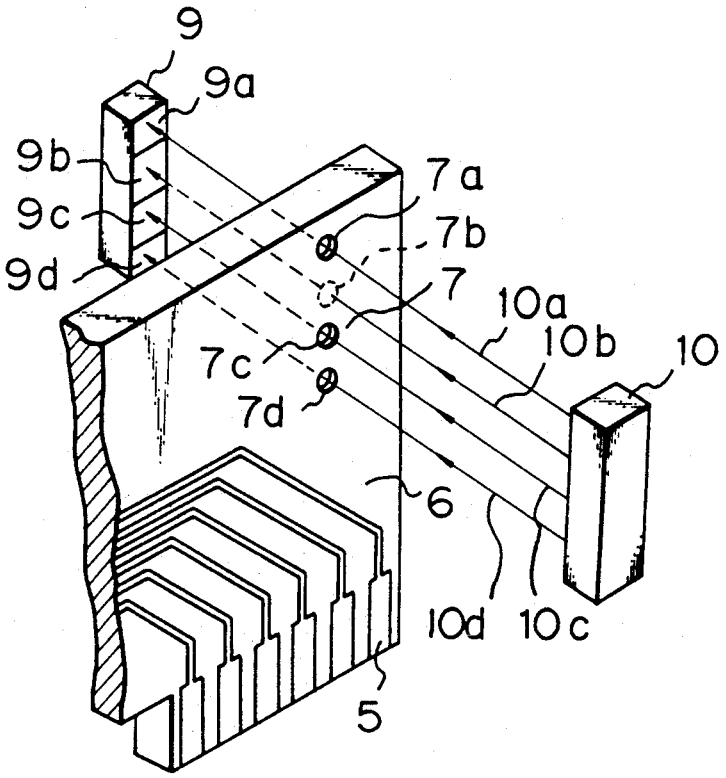
FIG. 7 is a schematic perspective view for illustrating the reading means of the liquid ejection recording apparatus shown in FIG. 6.

FIG. 7 is a schematic perspective view showing an example which uses optical means as the symbol reading means. In FIG. 7, reference numeral 9 designates a photosensor for detecting light. The photosensor 9 may suitably be a photodiode, a phototransistor, or the like. Light entering the photosensor 0 is applied by illuminating means (light-emitting means) 10.

In FIG. 7, the symbol display 7 is in the form of through-apertures formed in the substrate 6, except 7*b*. Accordingly, light beams 10*a*–10*b* emitted by the illuminating means 10 enter cells 9*a*–9*d* provided correspondingly to the symbol displays 7*a*–7*d* of the photosensor 9 except the symbol display 7*b*. (In FIG. 7, no light enters the cell 9*b*). By this, which of the symbol displays transparent to the light and which of the symbol displays are not is detected and by the detected information, the driving voltage of the recording head is adjusted to an optimum value or an optimum range.

In FIG. 7, the photosensor 9 and the illuminating means 10 are spaced apart from the display symbols, but it is preferable from the viewpoint of the compactness of the apparatus that they be installed so as to be substantially in intimate contact with the substrate 6.

The detected information may not only be automatically adjusted, but also may indicate the driving voltage value to the display means and may be manually adjusted. When the detected information is manually adjusted, the driving voltage can be adjusted very simply if, for example, the display means is made to effect a bar graph display or a pointer display so that adjustment can be effected by adjusting the pointer of the volume, or the like, to the position thereof.

According to the present invention, as described above, the driving voltage value inherent to each liquid ejection recording head can be clearly and accurately displayed by simple means and moreover, the occurrence of the trouble that the driving voltage value disappears or is lost during the transportation of the head is eliminated, and how to adjust the driving voltage generating circuit when actually changing the head can be judged at a glance. Also, cumbersome adjustment is unnecessary, and if the mounting of the recording head is done properly, stable image recording can always be accomplished.

Not only is the optimum driving voltage of the head displayed by the utilization of protrusions or apertures, but also the display corresponding to the type of the liquid contained in the head (for example, the color or the ink corresponding to the recording medium) may be added. In this latter case, it is also preferably to display the type of the liquid on the apparatus body side.

As discussed above and as shown in FIGS. 1, 2 and 7, for example, the symbol display 7 of the recording head 1 is independent of the energy generating members, which generate the energy utilized to form the ink droplets. The symbol display 7 is disposed at a predetermined location on the recording head 1, separate from the energy generating members, and indicates the value of a driving voltage to be supplied to the energy generating members.

Figure 8:
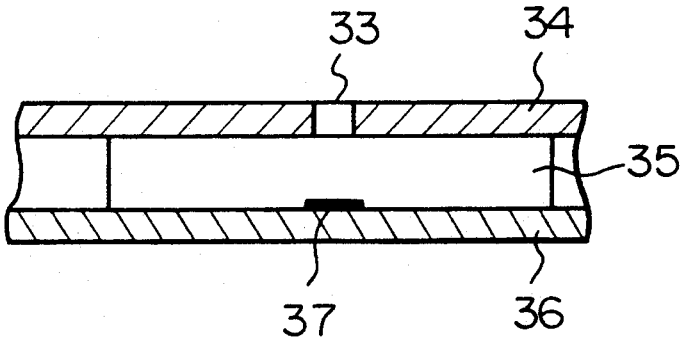
FIG. 8 is a partially sectional view for showing the construction of the liquid ejection recording head.

FIG. 8 shows the constitution of the liquid ejection recording head in which reference numeral 33 denotes an orifice from which a liquid flying droplet generated by an energy generating member 37, which may be an electro-thermal or electro-mechanical converting member, the orifice 33 being provided in an orifice plate 34.

The liquid needed for forming the droplets is supplied through a flow path 35.

Figure 9A:
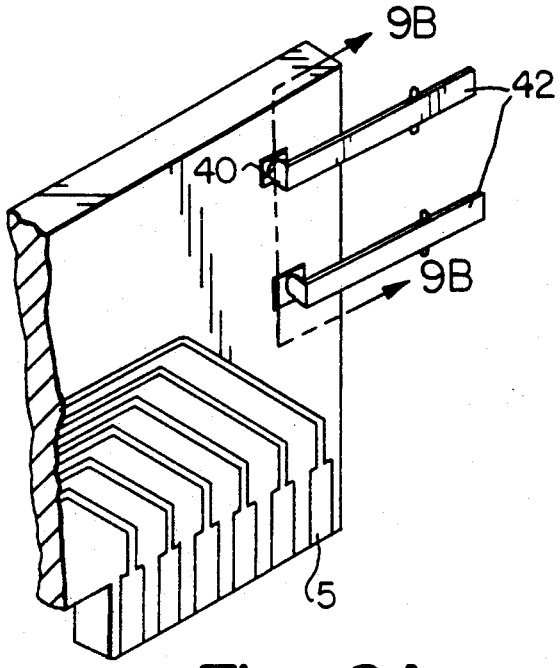
FIG. 9 comprising FIGS. 9A (perspective view) and 9B (cross-section from line 9B—9B of FIG. 9A), shows another embodiment.
Figure 9B:
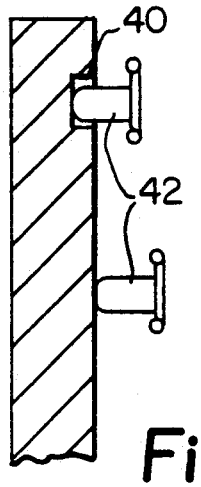
Figure 10:
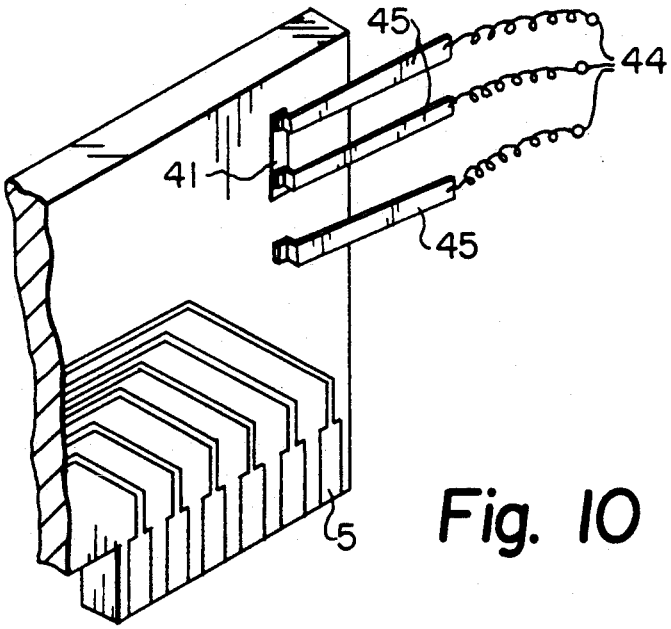
FIG. 10 shows another embodiment of the invention.
Figure 11:
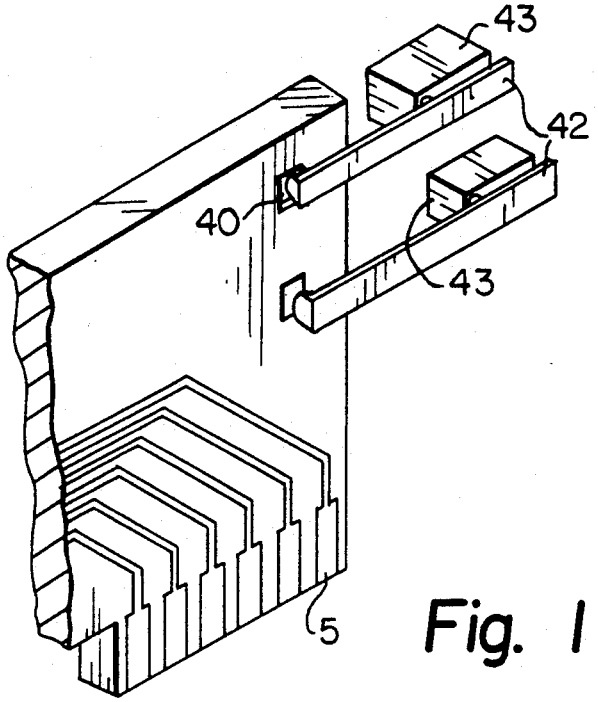
FIG. 11 shows another embodiment of the invention.

The symbolizing portions are not restricted to protrusions or apertures as described above, but may be cutaway or other concave portions 40, as shown in FIGS. 9A and 9B, provided in a head constituting member (for example, the substrate) or electrically conductive portions 41 provided separately from those connected to the energy generating members, as shown in FIG. 10. The reading of such symbolizing portions may suitably be accomplished not only by optical means utilizing the transmission or reflection of light as described above, but also by the mechanical means 42 shown in FIGS. 9 and 11 that detect mechanical displacement resulting from the contact or fitting between the binarized symbolizing portion and the apparatus body (for example, by using the switches 43, or another mechanico-electrical converting member such as a piezoelectric element, as shown in FIG. 11), or by the electrical means 44 shown in FIG. 10 that detect variations in electrical resistance (for example, through the electrical connections made by the contacts 45 or the like).

What I claim is:

1. A liquid ejection recording apparatus comprising:

(A) a liquid ejection recording head comprising:

(a) an electro-thermal energy converting member for generating thermal energy to discharge liquid when actuated, said electro-thermal energy converting member having an optimum driving voltage from among a range of values; and (b) a symbol for symbolizing one of plural numerical values for representing the optimum driving voltage of said electro-thermal energy converting member, wherein said symbol is disposed at a predetermined location on said recording head remote from said discharge port for reading of said symbol by reading means;

(B) voltage generating means for generating a driving voltage to actuate said electro-thermal energy converting member when said recording head is attached to said recording apparatus;

(C) reading means for reading said symbol to determine the optimum driving voltage of said electro-thermal energy converting member, wherein said reading means reads said symbol independently of the actuation of said electro-thermal energy converting member by said voltage generating means; and (D) control means for controlling the driving voltage generated by said voltage generating means to actuate said electro-thermal converting member in accordance with the optimum driving voltage read by said reading means.

2. A liquid ejection recording apparatus according to claim 1, wherein said reading means comprises optical means.

3. A liquid ejection recording apparatus according to claim 2, wherein said optical means comprises illuminating means and light-receiving means provided correspondingly to said symbol.

4. A liquid ejection recording apparatus according to claim 1, wherein said reading means comprises mechanical means.

5. A liquid ejection recording apparatus according to claim 4, wherein said mechanical means comprises a switch provided correspondingly to said symbol.

6. A liquid ejection recording apparatus according to claim 4, wherein said mechanical means comprises a mechanico-electrical converting member provided correspondingly to said symbol.

7. A liquid ejection recording apparatus according to claim 1, wherein said reading means comprises electrical means.

8. A liquid ejection recording apparatus according to claim 7, wherein said electrical means comprises a contact provided correspondingly to said symbol.

9. A liquid ejection recording apparatus according to claim 1, wherein said symbol is a binarized symbol.

10. A liquid ejection recording apparatus according to claim 1, wherein said symbol is a protruded portion provided on said recording head.

11. A liquid ejection recording apparatus according to claim 1, wherein said symbol is a concave portion provided in said recording head.

12. A liquid ejection recording apparatus according to claim 1, wherein said symbol is an aperture portion provided in said recording head.

13. A liquid ejection recording apparatus according to claim 1, wherein said symbol is an electrically conductive portion provided on said recording head.

14. A liquid ejection recording apparatus according to claim 1, wherein said symbol further comprises means for representing information relating to the type of liquid contained in said recording head.

15. A liquid ejection recording apparatus according to claim 1, further comprising a carriage and wherein said head is disposed on said carriage.

16. A liquid ejection recording apparatus according to claim 15, further comprising a sensor for detecting the home position of said carriage.

17. A liquid ejection recording apparatus according to claim 1, wherein said symbol further comprises means for representing information relating to the color of liquid contained in said recording head.

18. A liquid ejection recording apparatus according to claim 1, wherein the direction that the liquid is discharged is substantially the same as the direction that the liquid is supplied to said electro-thermal energy converting member.

19. A liquid ejection recording apparatus according to claim 1, wherein the direction that the liquid is discharged is different from the direction that the liquid is supplied to said electro-thermal energy converting member.

20. A liquid ejection recording apparatus according to claim 1, wherein said recording head comprises a head which produces images with a recording liquid that utilizes thermal energy for forming recording liquid droplets.

21. A liquid ejection recording apparatus according to claim 1, wherein said recording head further comprises wiring for electrically connecting said head to said recording apparatus.

22. A liquid ejection recording apparatus according to claim 1, wherein said symbol includes plural individual elements.

23. A liquid ejection recording apparatus according to claim 1, wherein said control means can re-set the driving voltage at predetermined intervals to maintain the optimum driving voltage.

* * * * *

UNITED STATES PATENT AND TRADEMARK OFFICE

CERTIFICATE OF CORRECTION

PATENT NO. : 5,235,351

DATED : August 10, 1993

INVENTOR(S) : YUTAKA KOIZUMI

It is certified that error appears in the above-identified patent and that said Letters Patent is hereby corrected as shown below:

COLUMN 1

Line 41, "studied" should read --studied.--.

COLUMN 2

Line 45, "high-degree" should read --high degree--.
Line 61, "manufactures" should read --manufacturer--.

COLUMN 5

Line 60, "displaying, portion displaying" should read --displaying portion, displaying--.

COLUMN 6

Line 28, "wit" should read --with--.

COLUMN 7

Line 30, "photosensor 0" should read --photosensor 9--.
Line 38, "displays" should read --displays are--.

COLUMN 8

Line 58, "said" should read --a--.

UNITED STATES PATENT AND TRADEMARK OFFICE

CERTIFICATE OF CORRECTION

PATENT NO. : 5,235,351

DATED : August 10, 1993

INVENTOR(S) : YUTAKA KOIZUMI

It is certified that error appears in the above-identified patent and that said Letters Patent is hereby corrected as shown below:

COLUMN 10

Line 10, "said head" should read --said recording head--.

Signed and Sealed this

Sixth Day of June, 1995

Bruce Lehman

*Attest:*

BRUCE LEHMAN

*Attesting Officer*

*Commissioner of Patents and Trademarks*